United States Patent [19]

Song et al.

[11] 4,240,629

[45] Dec. 23, 1980

[54] TETHERABLE GAME BALL

[76] Inventors: Jae M. Song, 225/46 Yeunhi/dong, Ma Po/Ku, Seoul, Rep. of Korea; Samuel B. Ligon, 5505 Emerson, Dallas, Tex. 75209

[21] Appl. No.: 1,742

[22] Filed: Jan. 8, 1979

[51] Int. Cl.[3] ..... A63B 39/00; A63B 43/02

[52] U.S. Cl. ..... 273/58 C; 273/58 F; 273/58 B

[58] Field of Search ..... 273/58 C, 95 A, 200 R, 273/58 B, 26 E, 29 A, 198, 200 A, 184 B, 185 C, 329, 330, 413, 331, 414, 58 F

[56] References Cited

U.S. PATENT DOCUMENTS

| | | | |
|---|---|---|---|
| 211,420 | 1/1879 | Moses | 273/58 C |
| 439,297 | 10/1890 | Heyder | 273/58 C |
| 600,967 | 3/1898 | Mead | 273/58 C |
| 667,563 | 2/1901 | Oakley | 273/58 C |
| 1,439,339 | 12/1922 | Smith | 273/198 |
| 1,502,058 | 7/1924 | Quin | 273/58 C |
| 2,747,873 | 5/1956 | Carroad | 273/58 C X |
| 2,942,883 | 6/1960 | Moore | 273/26 E |
| 3,051,491 | 8/1962 | Cabot | 273/95 A X |
| 3,147,979 | 9/1964 | Wolfe | 273/58 C X |
| 3,729,195 | 4/1973 | Hutt et al. | 273/58 C |
| 3,764,140 | 10/1973 | Lotfy | 273/95 A |
| 3,829,093 | 8/1974 | Abrams | 273/95 A |
| 4,014,553 | 3/1977 | Sakamoto | 273/200 R |
| 4,113,257 | 9/1978 | Moffatt | 273/58 C X |
| 4,162,790 | 7/1979 | Kelsey | 273/58 C |
| 4,186,921 | 2/1980 | Fox | 273/58 C |

FOREIGN PATENT DOCUMENTS

| | | | |
|---|---|---|---|
| 597176 | 5/1934 | Fed. Rep. of Germany | 273/58 C |

*Primary Examiner*—George J. Marlo

*Attorney, Agent, or Firm*—Richards, Harris & Medlock

[57] ABSTRACT

A tetherable game ball is provided that includes a resilient spherical hollow ball (12) having an aperture (14) through which a knotted line (17) extends therethrough and forms a loop extending exteriorly of hollow ball (12) allowing a tether to be secured thereto. Aperture (14) is tapered inwardly and prevents a rigid force distributing plug (20) located within hollow ball (12) from being pulled through and out of aperture (14). The game ball can be constructed so as to have rebound and elastic properties similar to those of a racquetball.

3 Claims, 5 Drawing Figures

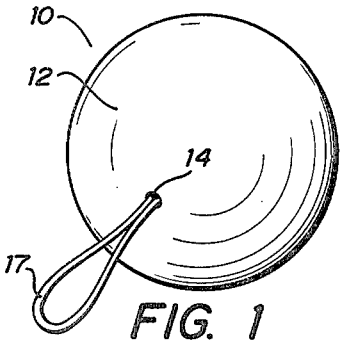
FIG. 1
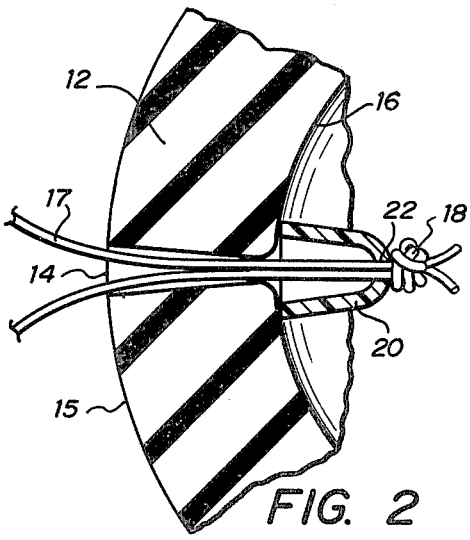
FIG. 2
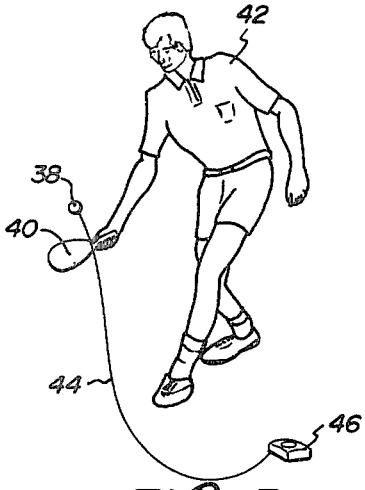
FIG. 5
FIG. 3
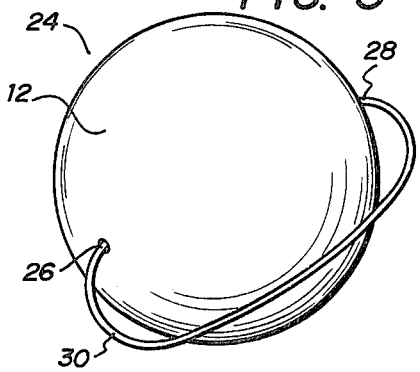
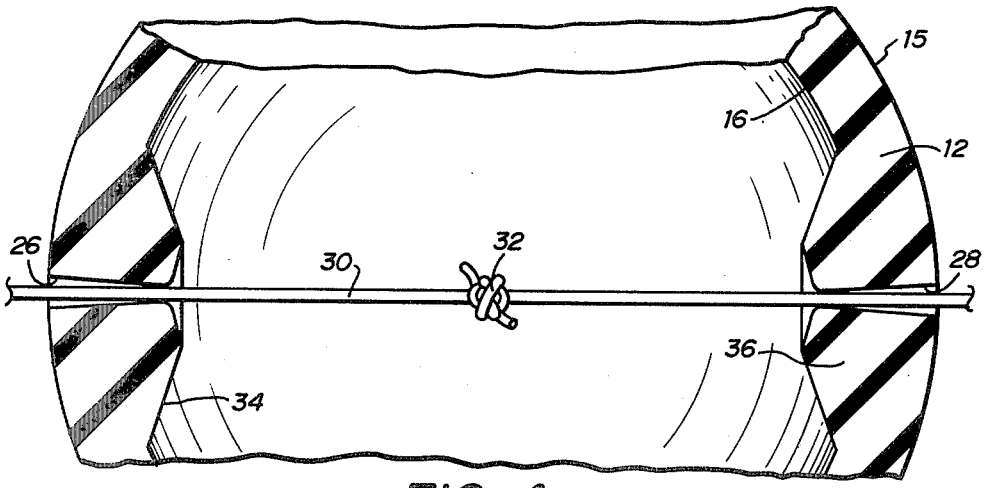
FIG. 4

TETHERABLE GAME BALL

TECHNICAL FIELD

This invention relates to game balls, and more particularly to game balls that are securable to a tether.

BACKGROUND ART

In the past, many games have been developed that utilize a game ball that is tethered. These games often involve the use of paddles, bats, golf clubs or other implements that are used to strike the game ball. Substantial forces are exerted on the game ball when it is accelerated by the striking implement and substantial forces are also exerted upon the game ball when it encounters the resistance of the tether. Typical tetherable game balls are described and claimed in U.S. Pat. Nos. 660,787 issued to Bissell on Oct. 30, 1900 entitled "Tether Ball"; 2,747,873 issued to Carroad on May 29, 1956 entitled "Tethered Ball Game Apparatus" and 3,051,491 issued to Cabot on Aug. 28, 1962 and entitled "Returnable Practice Golf Ball".

Such prior art tethered balls incorporate solid balls or have external attachments making them incompatible for certain types of games. In addition, such balls are subject to tearing and breaking away from the tether after extended use.

A need has thus arisen for a tetherable game ball that is simple in construction, resists tearing and breaking away from the tether and has characteristics of an untethered ball.

DISCLOSURE OF THE INVENTION

In accordance with the present invention, a tetherable game ball is provided.

In accordance with another aspect of the present invention, a tetherable game ball is provided that is hollow and the construction of the ball allows forces exerted between the ball and the tether to be distributed about a portion of the ball so that tearing of the ball associated with the tether is minimized.

One embodiment of the tetherable game ball of the present invention comprises a resilient, spherical hollow ball having a single aperture therein. The aperture has an inward taper that begins at the exterior surface of the hollow ball and extends over at least a portion of the length of the aperture. A line of predetermined length having both ends passed through the aperture and secured together forms a loop that extends exteriorly of the aperture to allow a tether to be secured to the loop. A plug, having a hole therein, through which said loop is threaded, is located within the ball, between the aperture and the knot formed by the two ends of the line, which knot is larger than the hole in the plug adjacent the knot, so that forces exerted upon the line are distributed by the plug about the aperture and the line cannot be pulled from the ball.

In accordance with a further aspect of the present invention, a hollow, tetherable game ball is provided in which a resilient, spherical hollow ball has two diametrically opposed apertures. Each of the apertures has an inward taper that begins at the exterior surface of the hollow ball and extends over at least a portion of the length of each of the two apertures. A line of predetermined length is passed through said apertures that is knotted at the ends, the knot being larger than the smallest diameter of the aperture and the knot being located within the hollow portion of the ball, the relative size of the aperture and the knot preventing the knot from being pulled outside of the ball. At each aperture, a boss forms an integral part of the ball. The boss is located interiorly of the ball with the apertures extending through the bosses, thereby reinforcing the ball and distributing forces exerted on the ball by the line in an area adjacent the apertures.

BRIEF DESCRIPTION OF DRAWINGS

A more complete understanding of the invention and its advantages will be apparent from the following detailed description taken in conjunction with the accompanying drawings in which:

FIG. 1 is a side elevation view of a tetherable ball according to the invention;

FIG. 2 is a side elevational sectional view of part of the tetherable game ball shown in FIG. 1;

FIG. 3 is a side elevational view that illustrates another embodiment of the tetherable game ball according to the invention;

FIG. 4 is a side elevational sectional view illustrating part of the tetherable game ball as shown in FIG. 3; and FIG. 5 is a picture showing the tetherable game ball being used.

DETAILED DESCRIPTION

FIG. 1 illustrates one preferred embodiment of the tetherable game ball according to the invention in which a side elevation view of single apertured tetherable game ball 10 is shown. Single apertured tetherable game ball 10 includes a resilient, spherical hollow ball 12 having aperture 14 therein having rebound characteristics similar to those of a racquetball. Preferably, aperture 14 is circular and tapered so that the diameter of aperture 14 decreases along at least a portion of the length of aperture 14 beginning at exterior surface 15 of hollow ball 12. In addition aperture 14 is preferable normal to exterior surface 15.

The decreasing taper of aperture 14 is best illustrated in FIG. 2 which shows a cross-sectional view of a portion of single apertured tetherable game ball 10. According to the invention, and as illustrated in FIG. 2, aperture 14 may be beveled at interior surface 16 of hollow ball 12. A flexible line 17, of predetermined length, may be constructed of nylon or string and has both ends secured together to form knot 18 located within hollow ball 12 forming a loop which passes through aperture 14. In accordance with the invention, structure is provided to distribute forces exerted between hollow ball 12 and line 17 in the area adjacent aperture 14 to provide for a more durable game ball.

In this embodiment, the structure is force distributing plug 20, located within resilient spherical hollow ball 12. Plug 20 also prevents line 17 from being pulled completely out of resilient spherical hollow ball 12 when a force is exerted upon line 17 that may occur, for example, when ball 10 is struck by a racket or when a tether exerts a force on line 17. Force distributing plug 20, a separate structure from hollow ball 12, is preferably wedge shaped or cone shaped having a rounded point and a flat base, oriented such that the flat base is adjacent interior surface 16, as shown in FIG. 2. The diameter of aperture 14 at interior surface 16 is smaller than the base of force distributing plug 20.

Plug 20 can be constructed of any rigid material, such as plastic or metal, and formed into the desired configuration by any method known to those skilled in the art, such as casting or injection molding. In assembling ball 10, both ends of line 17 can be threaded through hole 22 and then tied to form knot 18 while plug 20 is outside hollow ball 12, or the ends of line 17 can first be tied together to form knot 18 and then the loop formed can be inserted through hole 22. After assembly of plug 20 and line 17, knot 18 and plug 20 are inserted through aperture 14 into the hollow portion of ball 12, knot 18 being inserted first and followed by the rounded end of plug 20. The elasticity of hollow ball 12 allows aperture 14 to expand during insertion. Further, the wedge or cone shape of plug 20 facilitates the expansion of aperture 14 thereby facilitating insertion. A thin, rigid rod or other suitable implement can be used to facilitate insertion of plug 20 and knot 18 into the hollow portion of ball 12.

Hole 22 extends preferably through the longitudinal axis of force distributing plug 20, the diameter of hole 22 adjacent knot 18 being sufficiently smaller than the size of knot 18 so that knot 18 cannot pass through hole 22 when a force is exerted on line 17. When a force is exerted on line 17, plug 20 contacts resilient spherical hollow ball 12 adjacent aperture 14. When this occurs, the force exerted on line 17 is distributed over the area of resilient spherical hollow ball 12 that plug 20 contacts. Thus, reinforcing plug 20 distributes a force exerted upon line 17 over an area adjacent aperture 14 and prevents tearing of the wall of ball 10.

FIG. 3 illustrates another preferred embodiment of a tetherable game ball according to the invention. FIG. 3 is a side elevational view of double apertured tetherable game ball 24 in which the side walls of hollow ball 12 has therein apertures 26 and 28 which are diametrically opposed. Line 30 extends through both apertures 26 and 28, the ends of line 30 being tied to form knot 32 that is located within hollow ball 12. Each of apertures 26 and 28 are inwardly tapered along at least a portion of the length of those apertures, the taper beginning at exterior surface 15. The inward taper of apertures 26 and 28 prevent knot 18 from being pulled from the hollow portion of resilient spherical hollow ball 12, thus enhancing the appearance of the game ball.

Double apertured tetherable game ball 24 is assembled from hollow ball 12 and line 30 by inserting one end of line 30 through apertures 26 and 28 so that both ends of line 30 extend exteriorly of hollow ball 12. A thin wire or a thin rigid rod, or any other suitable implement can be used to facilitate insertion of line 30 through apertures 26 and 28. The ends of line 30 are then tied together to form knot 32 which can then be either pushed or pulled through one of apertures 26 and 28 so that knot 32 is located within hollow ball 12.

FIG. 4 is a side sectional elevational view of the double apertured tetherable game ball illustrated in FIG. 3. The force distribution structure shown in this embodiment consists of two bosses 34 and 36 which form an integral part of resilient spherical hollow ball 12. Bosses 34 and 36 form interior surface 16 adjacent apertures 26 and 28, apertures 26 and 28 extending through bosses 34 and 36, respectively. Bosses 34 and 36 allow distribution of forces exerted on resilient spherical hollow ball 12 by line 30 to prevent tearing of the game ball in the area adjacent apertures 26 and 28, making the game ball more durable. As shown in FIG. 4, apertures 26 and 28 are identical, and may include a shallow bevel at interior surface 16 of hollow ball 12 around each of apertures 26 and 28.

A tether is secured to line 30 by any suitable means, such as by tying a tether to line 30. The tether may be attached to a fixed location such as a base as shown in U.S. Pat. No. 2,747,873.

According to the invention, the ball may be made of rubber or any resilient material. Perferably, the ball will be made from a cross-linked synthetic rubber compound so that when formed in a pressureless hollow ball, characteristics similar to that of a racquetball will result. Alternatively, larger or smaller balls can be constructed according to the invention. Lines 17 and 30 are preferably constructed of nylon cord.

The design of the ball according to the invention provides a tetherable ball which is simple to construct in addition to being durable. Hollow ball 12 can be manufactured by any method or material known to those skilled in the art. For example, compression molding can be used to form a synthetic cross-linked rubber into a hollow ball having rebound and elastic characteristics similar to a racquetball and incorporating the formation of the aperture or apertures of the desired configuration. In both embodiments described herein, the apertures function as one-way valves for force distributing plug 20 in the embodiment shown in FIG. 1 and for knot 32 in the embodiment shown in FIG. 3. Force distributing plug 20 and knot 32 can be inserted through the aperture into the hollow portion of hollow ball 12, yet the aperture will restrain plug 20 or knot 32 from being extracted therefrom. The elastic properties of hollow ball 12 allow the aperture to stretch to permit the insertion of force distributing plug 20 or knot 32. The simplicity of construction allows line 30 to be easily replaced, should this become necessary.

FIG. 5 is an illustration of the tetherable game ball being used in a game for which it is suitable. The tetherable game ball is secured to one end of an elastic tether, the other end of the tether being secured to a suitable base. As illustrated in FIG. 5, the game ball is being used as a racquetball trainer, without the necessity of having a walled court. The game ball of the invention can also be used to play racquetball without a walled court. When game ball 38 in FIG. 5 is struck by racket 40 of player 42, ball 38 moves in the direction in which it is struck until the resistance of elastic tether 44 overcomes the momentum of ball 38 and accelerates ball 38 in a direction towards base 46 and player 42 allowing ball 38 to be struck again and thereby keep ball 38 in play.

While this invention has been described in relation to its preferred embodiments, it is to be understood that various modifications thereof will now be apparent to one skilled in the art upon reading this specification and it is intended to cover such modifications as fall within the scope of the appended claims.

We claim:

1. A game ball for being secured to a tether comprising:

a resilient spherical hollow ball having an interior surface and an exterior surface and an aperture normal to the exterior surface of said hollow ball and extending from the interior surface to the exterior surface of said hollow ball, said aperture having an inward taper beginning at said exterior surface and extending along at least a portion of the length of said aperture;

a line of predetermined length having two ends that are passed through said aperture, the line ends being secured together in the hollow portion of said ball to form a loop extending exteriorly of said spherical hollow ball for securing the tether thereto;

means for restraining the line from being pulled through said aperture;

means for distributing forces exerted between the line and said hollow ball to prevent tearing of said hollow ball by the line, said means for restraining and said means for distributing free of fixed attachment to said ball; and said means for restraining said line from being pulled through said aperture and said means for distributing forces including a rigid plug larger than the diameter of said aperture located entirely within said spherical hollow ball and having a hole extending therethrough with said loop passing through said hole, said rigid plug contacting an interior portion of said spherical hollow ball adjacent said aperture for distributing forces over the area of said ball that said rigid plug contacts when a force is exerted upon said line.

2. The game ball as recited in claim 1 wherein said line is knotted to form said loop, said knot being larger than the diameter of said hole adjacent said knot.

3. The game ball as recited in claim 2 wherein said plug has a flat base with said hole normal to said flat base and extending through said plug, said flat base being adjacent said aperture.

* * * * *